US007365763B2

(12) United States Patent
Takahashi et al.

(10) Patent No.: US 7,365,763 B2
(45) Date of Patent: Apr. 29, 2008

(54) THERMAL ACTIVATION APPARATUS, PRINTER, THERMAL ACTIVATION METHOD, AND METHOD OF MANUFACTURING ADHESIVE LABEL

(75) Inventors: Masanori Takahashi, Chiba (JP); Norimitsu Sanbongi, Chiba (JP); Minoru Hoshino, Chiba (JP); Tatsuya Obuchi, Chiba (JP)

(73) Assignee: Seiko Instruments Inc. (JP)

( * ) Notice: Subject to any disclaimer, the term of this patent is extended or adjusted under 35 U.S.C. 154(b) by 208 days.

(21) Appl. No.: 11/288,733

(22) Filed: Nov. 29, 2005

(65) Prior Publication Data

US 2006/0146116 A1 Jul. 6, 2006

(30) Foreign Application Priority Data

Jan. 5, 2005 (JP) ..... 2005-000608

(51) Int. Cl.
*B65C 9/25* (2006.01)
*B41J 2/32* (2006.01)

(52) U.S. Cl. ..... 347/223

(58) Field of Classification Search ..... 347/223, 347/171

See application file for complete search history.

(56) References Cited

U.S. PATENT DOCUMENTS 4,819,011 A 4/1989 Yokota
5,846,358 A * 12/1998 Nagamoto et al. ..... 156/64
6,031,553 A * 2/2000 Nagamoto et al. ..... 347/171
6,388,692 B1 * 5/2002 Iwata et al. ..... 347/212
6,501,495 B1 * 12/2002 Ichikawa et al. ..... 347/171
7,025,518 B2 * 4/2006 Hoshino et al. ..... 400/621
7,101,100 B2 * 9/2006 Hoshino et al. ..... 400/120.01
7,104,713 B2 * 9/2006 Hoshino et al. ..... 400/621
7,106,354 B2 * 9/2006 Sato et al. ..... 347/171
7,168,870 B2 * 1/2007 Sato et al. ..... 400/120.01
7,173,642 B2 * 2/2007 Nureki ..... 347/187
7,176,954 B2 * 2/2007 Takahashi et al. ..... 347/191
2003/0189631 A1 10/2003 Hoshino et al.
2004/0046857 A1 * 3/2004 Sato et al. ..... 347/203

FOREIGN PATENT DOCUMENTS

EP 1 393 917 A1 3/2004

* cited by examiner

*Primary Examiner*—Huan Tran
(74) *Attorney, Agent, or Firm*—Adams & Wilks

(57) ABSTRACT

A thermal activation apparatus includes a thermal head for thermal activation, a platen roller for thermal activation pressed against the thermal head, and an air cooling mechanism. The air cooling mechanism includes partitions for separating the thermal activation apparatus from the outside, an air outlet in a lower part thereof, first and second air inlets in an upper part thereof, and a fan for exhausting air through the air outlet. While a heat-sensitive adhesive agent layer of the heat-sensitive adhesive sheet is heated by the platen roller and the thermal head to be thermally activated during transporting the heat-sensitive adhesive sheet, the fan is actuated to generate airflow from the first and second air inlets and around the platen roller, the thermal head, and a heat sink, in this order, to be discharged to the outside from the air outlet.

12 Claims, 7 Drawing Sheets

THERMAL ACTIVATION APPARATUS, PRINTER, THERMAL ACTIVATION METHOD, AND METHOD OF MANUFACTURING ADHESIVE LABEL

BACKGROUND OF THE INVENTION

1. Field of the Invention

The present invention relates to a thermal activation apparatus for a heat-sensitive adhesive sheet with a heat-sensitive adhesive agent layer formed on one side of a sheet-like substrate, the heat-sensitive adhesive agent layer being normally nonadhesive and becoming adhesive by being heated and thermally activated, a thermal activation method, a printer provided with the thermal activation apparatus, and a method of manufacturing an adhesive label which is the heat-sensitive adhesive sheet cut at a predetermined length.

2. Description of the Related Art

A heat-sensitive adhesive sheet as disclosed in JP 11-79152A has been conventionally commercialized, which has a heat-sensitive adhesive agent layer that becomes adhesive by being heated. Such a heat-sensitive adhesive sheet is advantageous in that the sheet before being heated is easy to handle, no industrial waste is generated since no release liner is required, and the like. In order to generate adhesion of the heat-sensitive adhesive agent layer of the heat-sensitive adhesive sheet, for example, the heat-sensitive adhesive agent layer is heated by a thermal head which is generally used as a printhead in a thermal printer. When the other side of the heat-sensitive adhesive sheet which is opposite to the heat-sensitive adhesive agent layer is a heat-sensitive printable layer, there is also an advantage that printing and thermal activation can be carried out by similar thermal heads.

A printer for printing desired letters, numerals, images, and the like on a printable layer of such a heat-sensitive adhesive sheet, cutting the heat-sensitive adhesive sheet at a predetermined length, and generating adhesion of the heat-sensitive adhesive agent layer to manufacture, for example, an adhesive label stuck to a product for indicating its price, name, or the like has been developed (see JP 2003-316265A, JP 3,329,246B and JP 2004-10710A). Such a printer includes a printing apparatus for recording desired letters, numerals, symbols, images, and the like on the printable layer and a thermal activation apparatus for thermally activating the heat-sensitive adhesive agent layer to generate adhesion thereof. The printer further includes a transport mechanism for transporting the heat-sensitive adhesive sheet and a cutter mechanism for cutting the heat-sensitive adhesive sheet at a predetermined length into labels. The printing apparatus is provided with a thermal head and the thermal activation apparatus is also provided with a thermal head. The thermal heads have substantially the same structure. Platen rollers for supporting and transporting the heat-sensitive adhesive sheet are disposed so as to be opposed to the thermal heads, respectively.

Generally, in a thermal activation apparatus, thermal energy applied to a heat-sensitive adhesive agent layer of a heat-sensitive adhesive sheet for generating adhesion of the heat-sensitive adhesive sheet is on the order of 1.5 to 2 times as much as the thermal energy necessary for making a printable layer colored in a printing apparatus. In addition, in the thermal activation apparatus, the whole thermal head (all the dots) is operated all the time in order to uniformly generate adhesion of the heat-sensitive adhesive sheet by heating the whole surface of the heat-sensitive adhesive sheet. As a result, the total thermal energy applied to the heat-sensitive adhesive agent layer in the thermal activation apparatus is on the order of 6 to 8 times as much as the total thermal energy applied to the printable layer in the printing apparatus, and thus, overheating within the thermal activation apparatus is a problem. In particular, when the thermal activation apparatus is continuously operated for a long time in order to manufacture many adhesive labels continuously, the thermal head for thermal activation itself becomes too hot and may be damaged by the heat. Thermal heads in recent years often have integrated circuits (ICs) mounted thereon. When the temperature becomes 90° C. or higher, even when the heating elements of the thermal head are not abnormal, there is a high possibility that a thermal breakdown of the IC is caused. When the thermal activation apparatus is continuously operated, the temperature of the thermal head for thermal activation reaches 100° C.-200° C., which may break the IC and make the IC unusable.

In recent years, since a printer is required to be smaller, a heat sink attached to the thermal head can not be so large, and the natural cooling is not expected to be so effective. Further, in order to miniaturize the printer, a wide space for dissipating heat can not be secured around the thermal head for thermal activation. Therefore, heat from the thermal head for thermal activation raises the temperature of the atmosphere in the narrow space around the thermal head for thermal activation, and not only the temperature of the thermal head for thermal activation but also that of other adjacent members is raised. For example, when an operation member which is manually swung is provided adjacent to the thermal head for thermal activation in order to maintain the thermal head for thermal activation and a platen roller for thermal activation within the thermal activation apparatus, the operation member also becomes hot, and a user operating the operation member feels it hot and, in some cases, may suffer a burn.

A thermal head for printing of the printing apparatus of the printer comes in contact with and heats the printable layer of the heat-sensitive adhesive sheet, while the thermal head for thermal activation of the thermal activation apparatus is structured to come in contact with and heat the heat-sensitive adhesive agent layer which is a side opposite to the printable layer. However, in the thermal activation apparatus, the platen roller for thermal activation inevitably partially comes in direct contact with the thermal head for thermal activation adjacent, to an edge of the heat-sensitive adhesive sheet which is cut into labels, which allows heat from the thermal head for thermal activation to be, directly transferred to the platen roller for thermal activation. Further, the platen roller for thermal activation may be heated via air around the thermal head for thermal activation. Therefore, the temperature of the platen roller for thermal activation is liable to be raised. As a result, when the thermal activation apparatus is continuously operated, the printable layer may be unintentionally colored by being heated not only by the heat transferred from the heat-sensitive adhesive agent layer of the heat-sensitive adhesive sheet heated by the thermal activation apparatus in the thickness direction to the printable layer, but also by the heat stored by the platen roller for thermal activation which comes in contact with the platen roller for thermal activation. The unintentional color may be a meaningless blur or may smudge or make unreadable a desired letter, numeral, image, or the like.

In addition, if the heat of the thermal head for thermal activation is dissipated inside the printer including the thermal activation apparatus, the heat may be transferred even to a roll of the heat-sensitive adhesive sheet before being transported to the thermal activation apparatus which is located outside the thermal activation apparatus, the heat-sensitive adhesive agent layer wound into the roll may be thermally activated, and the heat-sensitive adhesive sheet may stick to each other in the roll.

SUMMARY OF THE INVENTION

Accordingly, an object of the present invention is to provide a thermal activation apparatus which can suppress overheating due to heat generated by a thermal head for thermal activation even when continuously operated, a printer provided with the thermal activation apparatus, a thermal activation method using the thermal activation apparatus, and a method of manufacturing an adhesive label.

According to the present invention, there is provided a thermal activation apparatus including: a thermal head for thermal activation for heating and thermally activating a heat-sensitive adhesive agent layer of a heat-sensitive adhesive sheet, the heat-sensitive adhesive sheet formed by forming a printable layer formed on one side of a sheet-like substrate and the heat-sensitive adhesive agent layer formed on the other side of the sheet-like substrate, respectively; a platen for thermal activation disposed so as to be opposed to the thermal head for thermal activation for passing the heat-sensitive adhesive sheet between the platen for thermal activation and the thermal head for thermal activation; and an air cooling mechanism for generating an airflow from the side of the platen for thermal activation to the side of the thermal head for thermal activation. According to an aspect of the present invention, both the platen for thermal activation and the thermal head for thermal activation can be efficiently cooled by the airflow to suppress overheating.

The air cooling mechanism may include a first air inlet as an inlet of the airflow located on the side of the thermal head for thermal activation with respect to the heat-sensitive adhesive sheet in an approaching state caught between the thermal head for thermal activation and the platen for thermal activation, a second air inlet as an inlet of the airflow located on the side of the platen for thermal activation, and an air outlet as an outlet of the airflow. In such a case, even when the heat-sensitive adhesive sheet blocks the airflow, the air taken in from the first air inlet and the air taken in from the second air inlet can efficiently cool the platen for thermal activation and the thermal head for thermal activation, respectively.

It is preferable that the air cooling mechanism includes partitions for substantially separating space where the airflow is caused from the outside, except for the outlet and the inlets of the airflow. This can prevent heat of the thermal head for thermal activation from being transferred to outside members with a deleterious effect. Further, since the airflow is easy to form which does not extend to the outside of the thermal activation apparatus and which clearly defines its direction from the side of the platen for thermal activation to the side of the thermal head for thermal activation, cooling effect can be obtained with reliability.

The air cooling mechanism may include a fan for exhausting air provided at or adjacent to the outlet of the airflow or a fan for intaking air provided at or adjacent to the inlet of the airflow.

According to another aspect of the present invention, a printer includes a thermal activation apparatus having one of the structures described in the above, a printing apparatus for printing by heating a printable layer, and a transport mechanism for transporting the heat-sensitive adhesive sheet through the thermal activation apparatus and the printing apparatus.

The printing apparatus includes a thermal head for printing by heating the printable layer of the heat-sensitive adhesive sheet and a platen for printing disposed so as to be opposed to the thermal head for printing for passing the heat-sensitive adhesive sheet between the platen for printing and the thermal head for printing, and the platen for thermal activation and the platen for printing form a part of the transport mechanism. Structuring the thermal head for thermal activation and the thermal head for printing substantially in the same way can lower the manufacturing cost.

According to another aspect of the present invention, a thermal activation method includes: the steps of thermally activating a heat-sensitive adhesive agent layer of a heat-sensitive adhesive sheet, the heat-sensitive adhesive sheet formed by forming a printable layer on one side of a sheet-like substrate and the heat-sensitive adhesive agent layer on the other side of the sheet-like substrate, by bringing the heat-sensitive adhesive agent layer in contact with a thermal head for thermal activation and driving the thermal head for thermal activation to heat the heat-sensitive adhesive agent layer; transporting, in synchronization with the thermally activating process, the heat-sensitive adhesive sheet between the thermal head for thermal activation; and a platen for thermal activation by the platen for thermal activation disposed so as to be opposed to the thermal head for thermal activation; and air cooling the platen for thermal activation and the thermal head for thermal activation to suppress overheating by generating airflow from the side of the platen for thermal activation to the side of the thermal head for thermal activation.

According to another aspect of the present invention, a method of manufacturing an adhesive label includes the steps of: printing on a printable layer of a heat-sensitive adhesive sheet, the heat-sensitive adhesive sheet formed by forming the printable layer on one side of a sheet-like substrate and a heat-sensitive adhesive agent layer on the other side of the sheet-like substrate, by bringing the printable layer in contact with a thermal head for printing and driving the thermal head for printing to heat the printable layer; thermally activating the heat-sensitive adhesive agent layer of the heat-sensitive adhesive sheet by bringing the heat-sensitive adhesive agent layer in contact with a thermal head for thermal activation and driving the thermal head for thermal activation to heat the heat-sensitive adhesive agent layer; transporting, in synchronization with the printing step and the thermally activating step, the heat-sensitive adhesive sheet between the thermal head for printing and the thermal head for thermal activation and two platens by the two platens disposed so as to be opposed to the thermal head for printing and the thermal head for thermal activation, respectively; cutting the heat-sensitive adhesive sheet at a predetermined length; and air cooling the platen opposed to the thermal head for thermal activation and the thermal head for thermal activation to suppress overheating by generating airflow from the side of the platen to the side of the thermal head for thermal activation.

According to these methods, since the thermal head for thermal activation and the platen can be cooled efficiently, heat activation can be conducted in sequence at short time intervals without taking much time to cool them, and thus, the temporal efficiency is very high.

The air cooling step is conducted simultaneously with the thermally activating step and the transporting step.

The air cooling step is preferably conducted with partitions substantially separating the airflow from the outside except for an outlet and an inlet of the airflow.

According to the present invention, the airflow can efficiently cool both the thermal head for thermal activation and the platen to suppress overheating of the thermal head for thermal activation and the platen. This can prevent unintentional coloring of the printable layer of the heat-sensitive adhesive sheet, a user from feeling that a housing or an operation member of the thermal activation apparatus is hot when the user touches them, and the risk of a burn of the user can be reduced.

DETAILED DESCRIPTION OF INVENTION

Embodiments of the present invention are now described with reference to the drawings.

Figure 1:
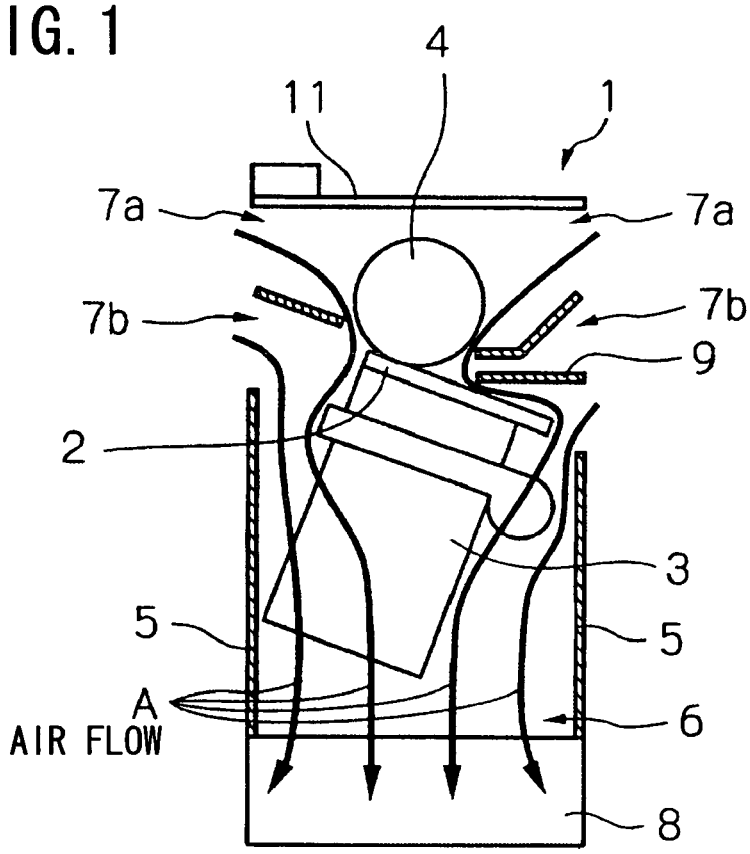
FIG. 1 is a schematic sectional view of a thermal activation apparatus according to the present invention.
Figure 2:
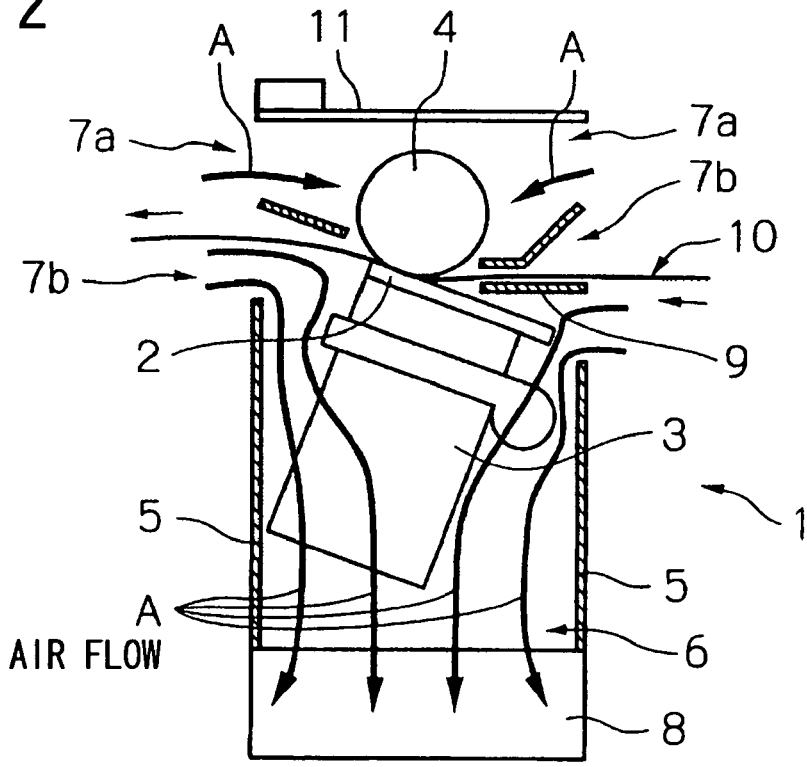
FIG. 2 is a schematic sectional view of the thermal activation apparatus according to the present invention with a heat-sensitive adhesive sheet fed thereto.
Figure 3:
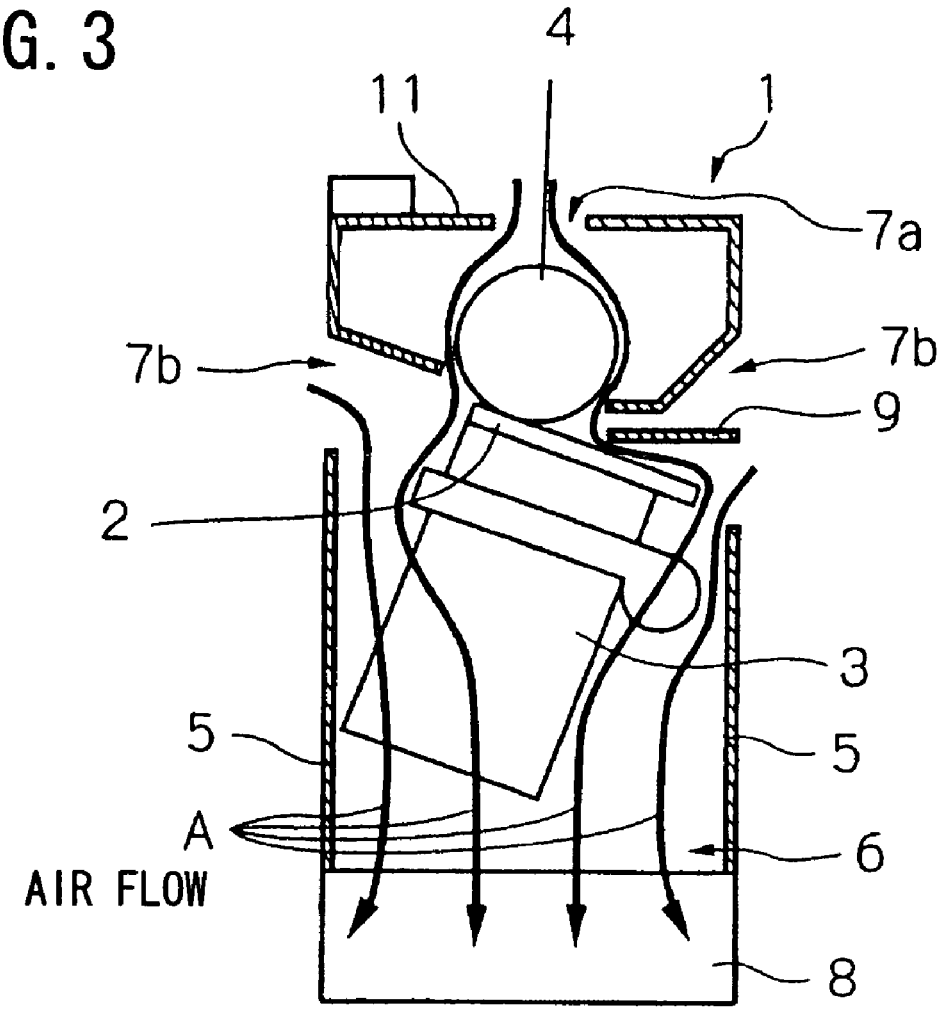
FIG. 3 is a schematic sectional view of a variation of the thermal activation apparatus according to the present invention.

FIGS. 1 and 2 are schematic sectional views illustrating the internal structure of a thermal activation apparatus 1 according to the present invention. As illustrated in FIGS. 1 and 2, the thermal activation apparatus 1 of the present embodiment includes a thermal head 2 for thermal activation having a plurality of heating elements arranged in a line in a width direction (not shown), a heat sink 3 supporting the thermal head 2 for thermal activation and made of a material having a high thermal conductivity such as aluminum, a platen roller 4 for thermal activation pressed against the thermal head 2 for thermal activation, and an air cooling mechanism. The air cooling mechanism includes partitions 5 for substantially separating the thermal activation apparatus 1 from the outside as a flow adjusting member made of a metal having a low thermal conductivity or the like, an air outlet 6 provided below the partitions 5 and open to the outside, and first and second air inlets 7*a* and 7*b* for intaking air arranged vertically above the partitions 5. Accordingly, the thermal activation apparatus 1 is substantially separated from the outside by the partitions 5 except for the first and second air inlets 7*a* and 7*b* and the air outlet 6. Further, the air cooling mechanism according to the present embodiment includes a fan 8 for exhausting air (schematically shown) in the air outlet 6. As shown in FIG. 2, the second air inlet 7*b* forms a path for a heat-sensitive adhesive sheet 10, and in the present embodiment, is provided with a guide 9. It is to be noted that the present invention is not limited to a structure where the first and second air inlets 7*a* and 7*b* are vertically arranged as shown in the figures. For example, as illustrated in FIG. 3, one or a plurality of small holes (preferably sized so as not to allow a finger of a user to be inserted therein) may be formed in an upper surface of an operation portion as the first air inlet 7*a*.

A swingable operation member 11 is provided in an upper portion of the thermal activation apparatus 1. The operation member 11 is operated manually by a user, and can have two states: an open state where the platen roller 4 for thermal activation or the thermal head 2 for thermal activation can be drawn out to the outside of the thermal activation apparatus 1; and a closed state where the platen roller 4 for thermal activation and the thermal head 2 for thermal activation are confined in the thermal activation apparatus 1 to be separated from the outside. The operation member 11 is normally closed. When, for example, a user replaces or maintains the platen roller 4 for thermal activation or the thermal head 2 for thermal activation or removes a jammed heat-sensitive adhesive sheet 10, the operation member 11 is manually opened.

The thermal head 2 for thermal activation is structured similarly to a known printhead for a thermal printer in which, for example, a protective film of crystallized glass is provided on the surface of a plurality of heater resistors formed on a ceramic substrate. This structure where heating is conducted by using many small heating elements (heater resistors) has an advantage that, compared with a structure where heating is conducted by using a single (or a small number of) large heating element(s), the temperature distribution can be made uniform more easily over a wide range. The thermal head 2 for thermal activation is located so as to be in contact with a heat-sensitive adhesive agent layer 10*a* of the heat-sensitive adhesive sheet 10, and the platen roller 4 for thermal activation is pressed against the thermal head 2 for thermal activation.

Figure 4:
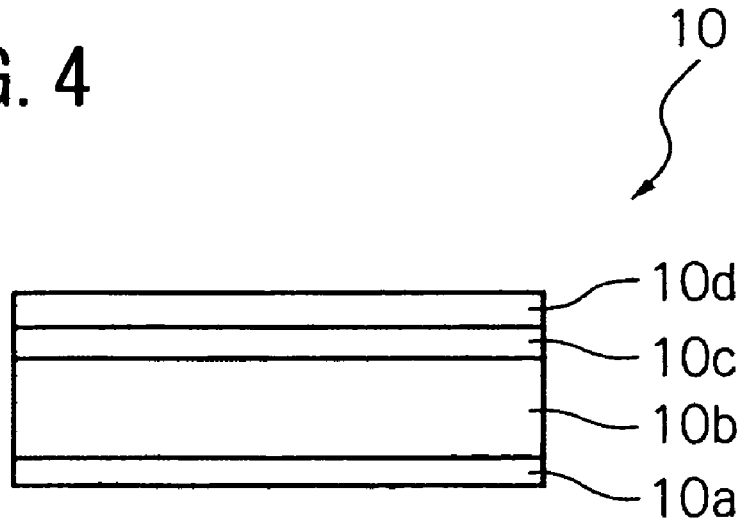
FIG. 4 is an enlarged view of a heat-sensitive adhesive sheet used for the thermal activation apparatus.

The heat-sensitive adhesive sheet 10 used in the present embodiment is, for example, as illustrated in FIG. 4, structured such that a thermal insulation layer 10*c* and heat-sensitive color forming layer (printable layer) 10*d* are formed on a front side of a sheet-like substrate 10*b*, while the heat-sensitive adhesive agent layer 10*a* is formed on a back side of the sheet-like substrate 10*b*. The heat-sensitive adhesive agent layer 10*a* is formed by applying and drying a heat-sensitive adhesive to be solidified having a thermoplastic resin, a solid plastic resin, or the like as the main ingredient. However, the heat-sensitive adhesive sheet 10 is not limited thereto, and various modifications are possible which have the heat-sensitive adhesive agent layer 10*a*. For example, a heat-sensitive adhesive sheet 10 having a structure without the thermal insulation layer 10*c*, a structure with a protective layer or a colored printing layer (preprinted layer) (not shown) provided on the surface of the printable layer 10*d*, or a structure with a thermal coating layer can also be used.

In the thermal activation apparatus according to the present embodiment structured as in the above, when the heat-sensitive adhesive sheet 10 is guided by the guide 9 in the second air inlet 7*b* and is advanced, the heat sensitive adhesive sheet 10 is caught between the thermal head 2 for thermal activation and the platen roller 4 for thermal activation. While pressing the heat-sensitive adhesive sheet 10 against the thermal head 2 for thermal activation by the platen roller 4 for thermal activation, by the thermal head 2 for thermal activation actuated to generate heat, the heat-sensitive adhesive agent layer 10*a* in contact with the thermal head 2 for thermal activation is heated, and thermally activated. At the same time, the platen roller 4 for thermal activation rotates to transport the heat-sensitive adhesive sheet 10 with the whole surface of the heat-sensitive adhesive agent layer 10*a* pressed against the thermal head 2 for thermal activation. Thereby, adhesion is generated on the whole surface of the heat-sensitive adhesive agent layer 10*a* on one side of the heat-sensitive adhesive sheet 10.

In the present embodiment, when the heat-sensitive adhesive sheet 10 is transported and thermally activated, the air cooling mechanism generates airflow A for cooling. Specifically, the fan 8 for exhausting air is actuated to generate the airflow A that the air in the thermal activation apparatus 1 is advanced from the side of the platen roller 4 for thermal activation to the side of the thermal head 2 for thermal activation (downward in the figure). The inlet of the airflow A, that is, the intake of air, is the first and second air inlets 7*a* and 7*b*. The outlet of the airflow A, that is, the discharge outlet of air, is the air outlet 6. The partitions 5 prevent the airflow A from extending to the outside of the thermal activation apparatus 1. In this way, actuation of the fan 8 for exhausting air generates the airflow A drawn in from the first and second air inlets 7*a* and 7*b* and passing the surroundings of the platen roller 4 for thermal activation, the thermal head 2 for thermal activation, and the heat sink 3 in this order to be discharged from the air outlet 6 to the outside of the thermal activation apparatus 1. The airflow A suppresses overheating of the thermal head 2 for thermal activation and temperature rise of the thermal head 2 for thermal activation itself and of adjacent members and the atmosphere, which is so-called air cooling action. This not only eliminates the conventional inconvenience due to overheating of the thermal head 2 for thermal activation and the platen roller 4 for thermal activation but also suppresses overheating of the operation member 11, and prevents a user who manually operates the operation member 11 from feeling it hot.

If airflow opposite in direction to the airflow A as illustrated in FIGS. 1 and 2, that is, airflow from the side of the thermal head 2 for thermal activation to the side of the platen roller 4 for thermal activation (upward in the figure) is generated, the air whose temperature has been raised by absorbing the heat of and cooling the thermal head 2 for thermal activation is brought into contact with the platen roller 4 for thermal activation. More specifically, the air heated by the thermal head 2 for thermal activation is brought into contact with the platen roller 4 for thermal activation. In this case, the platen roller 4 for thermal activation is far from being cooled, and rather, is likely to be heated. That is, if the air after cooling the thermal head 2 for thermal activation is brought into contact with the platen roller 4 for thermal activation, the air after cooling the thermal head 2 for thermal activation becomes heated and is thought to be at a considerably elevated temperature (for example, on the order of 60° C.). In that case, when the air is brought in contact with the platen roller 4 for thermal activation, it consequently prevents cooling. Further, in some cases, the air after cooling the thermal head 2 for thermal activation and/or the air whose temperature has been raised adjacent to the thermal head 2 for thermal activation may become hotter than the platen roller 4 for thermal activation, which may heat the platen roller 4 for thermal activation. In that case, though the thermal head 2 for thermal activation is cooled, various drawbacks due to overheating of the platen roller 4 for thermal activation (for example, unintentional coloring of the printable layer 10*d*) may be caused.

On the other hand, according to the present embodiment, since the airflow A from the side of the platen roller 4 for thermal activation to the side of the thermal head 2 for thermal activation (downward in the figure) is generated, cool air taken in from the first and second air inlets 7*a* and 7*b* is directly brought into contact with the platen roller 4 for thermal activation, and a great cooling effect can be obtained, Therefore, the above-described conventional drawback due to overheating of the platen roller for thermal activation can be eliminated. Next, the air which has cooled the platen roller 4 for thermal activation is brought into contact with and cools the thermal head 2 for thermal activation and the heat sink 3. Since the platen roller 4 for thermal activation itself does not generate heat, the air after cooling the platen roller 4 for thermal activation is not thought to become hotter than the thermal head 2 for thermal activation (for example, higher than 60° C.), and still has a cooling effect on the thermal head 2 for thermal activation and the heat sink 3. Therefore, the structure according to the present embodiment can efficiently cool both the platen roller 4 for thermal activation and the thermal head 2 for thermal activation. In this way, by the airflow A in the direction defined by the present invention, an excellent cooling effect on the platen roller 4 for thermal activation and the thermal head 2 for thermal activation can be obtained.

Further, as illustrated in FIG. 2, when the heat-sensitive adhesive sheet 10 is between the platen roller 4 for thermal activation and the thermal head 2 for thermal activation, air taken in from the first air inlet 7*a* to cool the platen roller 4 for thermal activation flows, although not shown in the figure, around edges of the heat-sensitive adhesive sheet 10 downward to the heat-sensitive adhesive sheet 10, that is, to the side of the thermal head 2 for thermal activation to cool the thermal head 2 for thermal activation. Part of the air which has cooled the platen roller 4 for thermal activation may be blocked by the heat-sensitive adhesive sheet 10 and may not flow downward (to the side of the thermal head 2 for thermal activation). However, with the structure of the present embodiment, air is also taken in from the second air inlet 7*b* and is directly brought into contact with and cools the thermal head 2 for thermal activation. In this way, since the first and second air inlets 7*a* and 7*b* are provided on the side of the platen roller 4 for thermal activation and on the side of the thermal head 2 for thermal activation, respectively, with the heat-sensitive adhesive sheet 10 therebetween, even when the heat-sensitive adhesive sheet 10 is between the platen roller 4 for thermal activation and the thermal head 2 for thermal activation, both the platen roller 4 for thermal activation and the thermal head 2 for thermal activation can be sufficiently cooled.

Figure 5B:
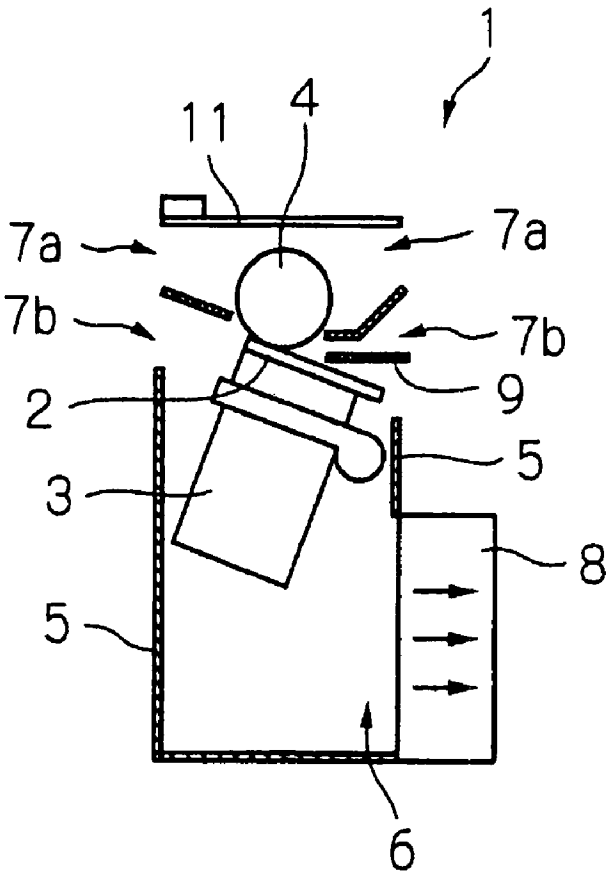
FIG. 5B is a schematic sectional view of the variation of the thermal activation apparatus according to the present invention.
Figure 5A:
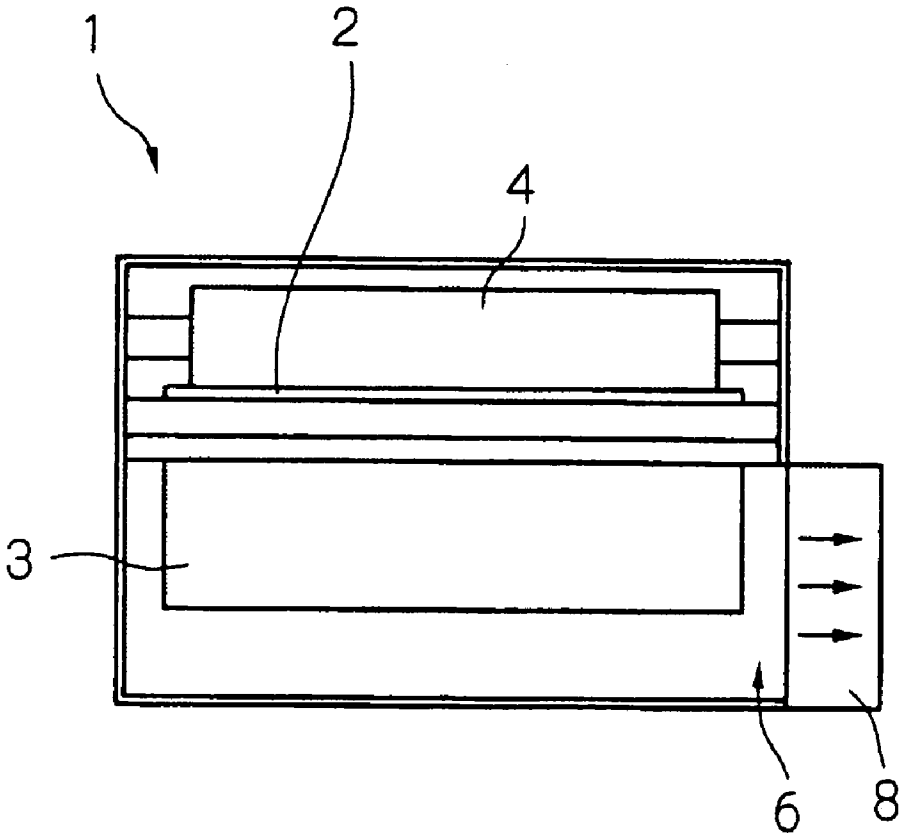
FIG. 5A is a schematic side view of another variation of the thermal activation apparatus according to the present invention.

The specific structure of the air cooling mechanism is not limited to the one illustrated in the figures. Though, in FIGS. 1 and 2, the air outlet 6 and the fan 8 for exhausting air of the air cooling mechanism are disposed at the bottom of the thermal activation apparatus 1, they may be disposed at, for example, a lower side of the thermal activation apparatus 1 as illustrated in FIGS. 5A and 5B. In this way, the layout of the air outlet 6 and the fan 8 for exhausting air is arbitrary insofar as the design of the apparatus housing, the performance of the fan 8 for exhausting air, and the like are taken into consideration. Since air discharged to the outside from the air outlet 6 may be hot after absorbing the heat of the platen roller 4 for thermal activation, the thermal head 2 for thermal activation, and the heat sink 3, it is preferable that the air outlet 6 is disposed away from at least the platen roller 4 for thermal activation and the operation member 11.

Though, as illustrated in FIGS. 1, 2, and 5, the air cooling mechanism is structured to include the fan 8 for exhausting air provided for the air outlet 6, the structure may include a fan for intaking air disposed at an upstream side of the platen roller 4 for thermal activation instead of the fan 8 for exhausting air as illustrated in FIG. 6, and the fan for intaking air may generate airflow.

Figure 6B:
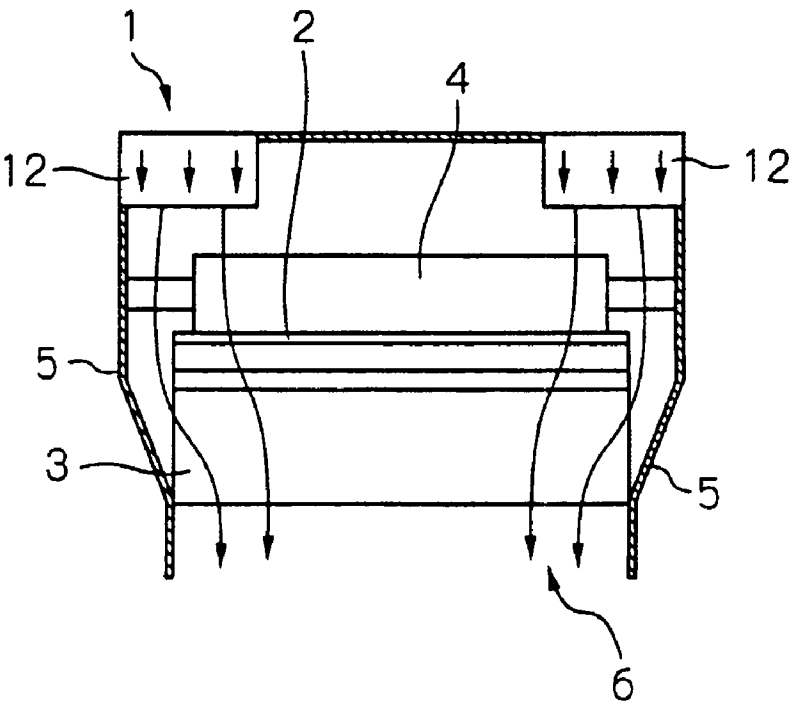
FIG. 6B is a schematic side view of yet another variation of the thermal activation apparatus according to the present invention.
Figure 6A:
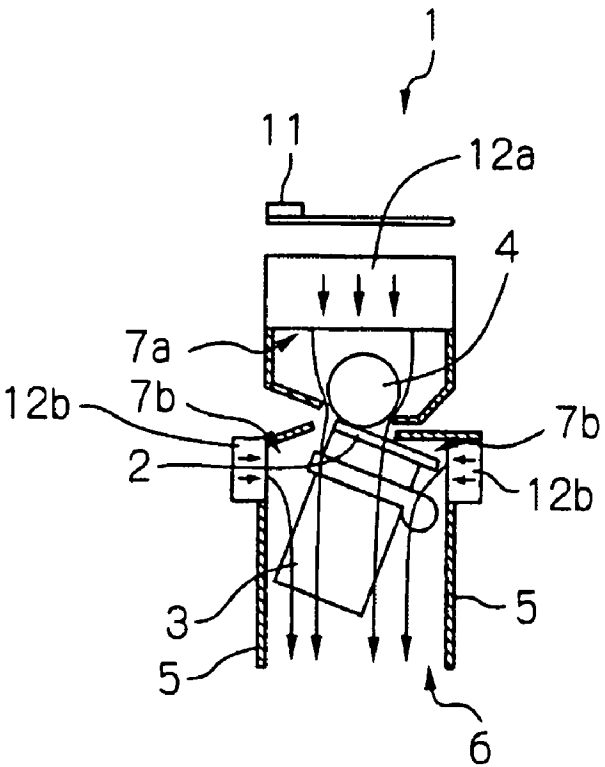
FIG. 6A is a schematic sectional view of still another variation of the thermal activation apparatus according to the present invention.

As in the structure illustrated in FIG. 6A, the first air inlet 7*a* above the platen roller 4 for thermal activation and the thermal head 2 for thermal activation is provided with a first fan 12*a* for intaking air. The second air inlet 7*b*, which is under the heat-sensitive adhesive sheet 10 when the heat-sensitive adhesive sheet 10 is between the platen roller 4 for thermal activation and the thermal head 2 for thermal activation, is provided with a second fan 12*b* for intaking air. In FIG. 6A, the second air inlet 7*b* is provided separately from the path of the heat-sensitive adhesive sheet 10 through the thermal activation apparatus 1, and, in order to prevent air for cooling from leaking out through the path of the heat-sensitive adhesive sheet 10, the partitions 5 are bent so as to block a part of the path. Wind produced by the first fan 12*a* for intaking air is equal to or stronger than that produced by the second fan 12*b* for intaking air to prevent backflow of air. With this structure, when the heat-sensitive adhesive sheet 10 is between the platen roller 4 for thermal activation and the thermal head 2 for thermal activation, even if air taken in by the first fan 12*a* for intaking air from the first air inlet 7*a* to cool the platen roller 4 for thermal activation is blocked by the heat-sensitive adhesive sheet 10 and does not flow downward (to the side of the thermal head 2 for thermal activation), air taken in by the second fan 12*b* for intaking air from the second air inlet 7*b* cools the thermal head 2 for thermal activation.

As in the structure illustrated in FIG. 6B, the partitions 5 are bent to provide a gap at sides of the platen roller 4 for thermal activation and the thermal head 2 for thermal activation, and a fan 12 for intaking air is provided above the platen roller 4 for thermal activation and the thermal head 2 for thermal activation such that at least a part thereof is located over the gap. With this structure, even when the heat-sensitive adhesive sheet 10 is between the platen roller 4 for thermal activation and the thermal head 2 for thermal activation, a part of the air taken in by the fan 12 for intaking air passes downward through the gap at the sides of the platen roller 4 for thermal activation and the thermal head 2 for thermal activation. Since the air cools the heat sink 3 which has a high thermal conductivity and is integral with the thermal head 2 for thermal activation, the thermal head 2 for thermal activation can be sufficiently cooled.

Further, though not shown in the figures, the structure may be such that airflow is generated by using means other than a fan (for example, a pump). When strong airflow can be generated by a fan or other means, a structure with which partitions 5 is not provided may be possible.

The present invention is also applicable to a structure having a flat platen for thermal activation rather than a roller-shaped one.

Next, a printer incorporating the above-described thermal activation apparatus 1 according to the present embodiment is described with reference to FIG. 7.

Figure 7:
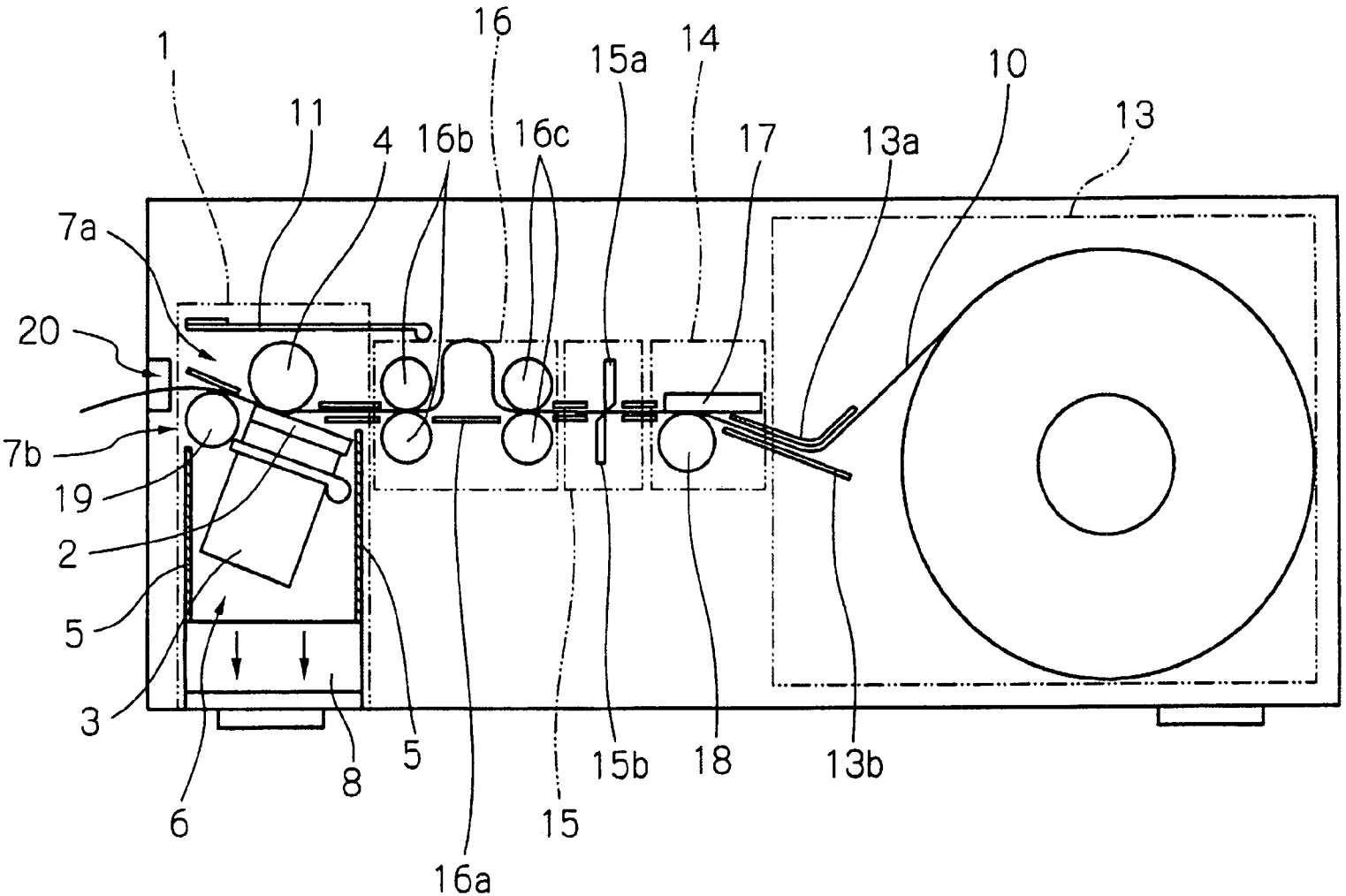
FIG. 7 is a schematic sectional view of a printer according to the present invention.

A basic structure of a printer for a heat-sensitive adhesive sheet illustrated in FIG. 7 is briefly described first. The printer is provided with a roll holding mechanism 13 for holding the heat-sensitive adhesive sheet 10 wound into a roll, a printing apparatus 14 for printing on a printable layer 10*d* (see FIG. 4) of the heat-sensitive adhesive sheet 10, a cutter mechanism 15 for cutting the heat-sensitive adhesive sheet 10 at a predetermined length, the above-described thermal activation apparatus 1 for thermally activating the heat-sensitive adhesive agent layer 10*a* (see FIG. 4) of the heat-sensitive adhesive sheet 10, and a guide mechanism 16 for guiding the heat-sensitive adhesive sheet 10 from the cutter mechanism 15 to the thermal activation apparatus 1. It is to be noted that, though, in reality, the heat-sensitive adhesive sheet 10 is cut by the cutter mechanism 15 and the heat-sensitive adhesive sheet 10 cut into shorter labels are transported downstream from the cutter mechanism 15, FIG. 7 illustrates the long heat-sensitive adhesive sheet 10 being transported as it is for the sake of clarity of the transport path of the heat-sensitive adhesive sheet 10.

Guides 13*a* and 13*b* for the heat-sensitive adhesive sheet 10 drawn out from the roll are provided in adjacent to the roll holding mechanism 13.

The printing apparatus 14 includes a thermal head 17 for printing having a plurality of heating elements which are relatively small resistors arranged in a width direction (in a direction perpendicular to the plane of FIG. 7) to enable dot printing and a platen roller 18 for printing which is pressed against the thermal head 17 for printing. The thermal head 17 for printing is located so as to be in contact with the printable layer 10*d* of the heat-sensitive adhesive sheet 10 transported from the roll holding mechanism 13, and the platen roller 18 for printing is pressed against the thermal head 17 for printing. The thermal head 17 for printing is structured similarly to the thermal head 2 for thermal activation of the thermal activation apparatus 1 described in the above, in other words, is structured similarly to a known printhead for a thermal printer in which, for example, a protective film of crystallized glass is provided on the surface of a plurality of heater resistors formed on a ceramic substrate. In this way, structuring the thermal head 17 for printing and the thermal head 2 for thermal activation in the same way allows commonality of components to lower the cost.

The cutter mechanism 15 cuts the heat-sensitive adhesive sheet 10 on which printing has been carried out by the printing apparatus 14 at a predetermined length into labels, and has a movable blade 15*b* driven by a driving source such as an electric motor (not shown) and an opposing fixed blade 15*a*.

The guide mechanism 16 is formed of a plate-like guide 16*a* provided in the transport path from the cutter mechanism 15 to the thermal activation apparatus 1, and pairs of rollers 16*b* and 16*c* provided at a sending portion of the cutter mechanism and an inserting portion of a thermally activating unit 5, respectively. The guide mechanism 16 smoothly introduces the heat-sensitive adhesive sheet 10 into the thermal activation apparatus 1 and temporarily sags and holds the heat-sensitive adhesive sheet 10 at a downstream side of the cutter mechanism 15 in order to cut the heat-sensitive adhesive sheet 10 at a predetermined length.

The thermal activation apparatus 1 is structured as described in the above, and includes the thermal head 2 for thermal activation, the heat sink 3, the platen roller 4 for thermal activation, the partitions 5, the air outlet 6, the first and second air inlets 7*a* and 7*b*, the guide 9, the fan 8 for exhausting air, and the operation member 11. Further, a discharge roller 19 is provided for discharging the heat-sensitive adhesive sheet 10 which has passed between the thermal head 2 for thermal activation and the platen roller 4 for thermal activation to the outside of the printer via an opening 20.

The platen roller 18 for printing, the pairs of rollers 16*b* and 16*c*, the platen roller 4 for thermal activation, and the discharge roller 19 form a transport mechanism for transporting the heat-sensitive adhesive sheet 10 through the whole printer.

Though not shown in the figure, the printer includes a controller for driving and controlling the operation of the above-described transport mechanism, a movable blade 15*b*, a thermal head 17 for printing, a thermal head 2 for thermal activation, and the like.

A method of manufacturing, by using the printer structured as in the above, a desired adhesive label made of the heat-sensitive adhesive sheet 10 is now described.

First, the heat-sensitive adhesive sheet 10 drawn out from the roll holding mechanism 13 is guided by the guides 13*a* and 13*b* to be inserted between the thermal head 17 for printing and the platen roller 18 for printing of the printing apparatus 14. Print signals are supplied from the controller to the thermal head 17 for printing, a plurality of heating elements of the thermal head 17 for printing is selectively driven to generate heat at an appropriate timing, and printing is conducted on the printable layer 10*d* of the heat-sensitive adhesive sheet 10. In synchronization with the driving of the thermal head 17 for printing, the platen roller 18 for printing is driven to rotate to transport the heat-sensitive adhesive sheet 10 in a direction crossing the direction of the line of the heating elements of the thermal head 17 for printing, for example, in a direction perpendicular to the line of the heating elements. Specifically, by alternately repeating the printing for one line by the thermal head 17 for printing and the transporting of the heat-sensitive adhesive sheet 10 by a predetermined amount (for one line) by the platen roller 18 for printing, desired letters, numerals, symbols, images, and the like are printed on the heat-sensitive adhesive sheet 10.

The heat-sensitive adhesive sheet 10 on which printing has been conducted in this way passes between the movable blade 15*b* and the fixed blade 15*a* of the cutter mechanism 15 to reach the guide mechanism 16. At the guide mechanism 16, the heat-sensitive adhesive sheet 10 is sagged as needed, and a length from the leading edge of the heat-sensitive adhesive sheet 10 to a portion located between the movable blade 15*b* and the fixed blade 15*a* of the cutter mechanism 15 is set. For example, when the predetermined length of the adhesive label to be manufactured is longer than the distance between the pair of rollers 16*b* and the movable blade 15*b* and the fixed blade 15*a* of the cutter mechanism 15, by stopping the pair of rollers 16*b* for a time and rotating the platen roller 18 for printing and the pair of rollers 16*c* with the leading edge of the heat-sensitive adhesive sheet 10 caught between the pair of rollers 16*b*, the heat-sensitive adhesive sheet 10 is sagged in the guide mechanism 16 so that the length of the heat-sensitive adhesive sheet 10 between the leading edge and the portion located between the movable blade 15*b* and the fixed blade 15*a* of the cutter mechanism 15 is the predetermined length. Here, the movable blade 15*b* is driven to cut the heat-sensitive adhesive sheet 10.

Next, the pair of rollers 16*b* are rotated to transport the heat-sensitive adhesive sheet 10 on which necessary printing has been conducted and which has been cut at the predetermined length into a label as described in the above to the thermal activation apparatus 1. Then, at the thermal activation apparatus 1, the controller drives the thermal head 2 for thermal activation to heat and thermally activate the heat-sensitive adhesive agent layer 10*a* in contact therewith, with the heat-sensitive adhesive sheet 10 in a shape of a label caught between the thermal head 2 for thermal activation and the platen roller 4 for thermal activation. At the same time, the platen roller 4 for thermal activation is rotated to transport the heat-sensitive adhesive sheet 10 in the shape of a label with the whole surface of the heat-sensitive adhesive agent layer 10*a* brought in contact with the thermal head 2 for thermal activation.

In this way, the adhesive label having the predetermined length is completed which is formed of the heat-sensitive adhesive sheet 10 having desired printing conducted on one side thereof and adhesion generated on the other side thereof.

While manufacturing the adhesive label by the printer, the fan 8 for exhausting air of the air cooling mechanism continues to operate to generate the airflow A (see FIGS. 1 and 2) within the thermal activation apparatus 1 which is defined by the partitions 5 and passes from the first and second air inlets 7*a* and 7*b* and around the platen roller 4 for thermal activation, the thermal head 2 for thermal activation, and the heat sink 3 in this order to be discharged to the outside of the printer from the air outlet 6. As described in the above, the airflow A can efficiently cool the platen roller 4 for thermal activation and the thermal head 2 for thermal activation to prevent overheating.

In this structure, since the inside of the thermal activation apparatus 1 is substantially separated from the outside by the partitions 5 except for the first and second air inlets 7*a* and 7*b* and the air outlet 6, the airflow A only flows within the thermal activation apparatus 1 and does not transfer heat to the outside thereof. In other words, the heat generated by the thermal head 2 for thermal activation is dealt with within the thermal activation apparatus 1, and, since the partitions 5 separate the inside and the outside of the thermal activation apparatus 1, does not affect the outside of the thermal activation apparatus 1. Therefore, the whole inside of the printer need not be designed with a consideration of exhaustion of the great amount of heat generated by the thermal head 2 for thermal activation, and thus, the design of the inside of the printer becomes easier. Further, the heat-sensitive adhesive sheet 10 wound into the roll in a roll holding mechanism 13 which is distant from the thermal activation apparatus 1 does not stick to each other in the roll.

As shown in Table 1, the temperature of a platen roller for thermal activation of a conventional structure typically rises to about 60° C. When an airflow of an opposite direction to that of the present invention, that is, an airflow from the side of the thermal head for thermal activation to the platen roller for thermal activation is generated, the platen roller for thermal activation is cooled to about 55° C.

It is noted that Table 1 shows the temperatures of the platen roller for thermal activation, the operation member, and a lock arm of a printer illustrated in FIG. 7 according to an embodiment described below at the environment temperature of 25° C., when many adhesive labels which were 150 mm in length and 102 mm in width were manufactured every one second, compared with those of a conventional printer and of a case where an airflow of the opposite direction was generated. The lock arm will be described below.

TABLE 1

| | Platen Roller for Thermal Activation | Operation Member | Lock Arm |
|---|---|---|---|
| Conventional Structure (without airflow) | | | |
| Prior to Thermal Activation | 24° C. | 24° C. | 24° C. |
| When Thermal Head for Thermal Activation Reaches 91° C. | 60° C. | 37° C. | 48° C. |
| Structure where Airflow of Opposite Direction to that of Airflow of the Present Invention is Generated | | | |
| Prior to Thermal Activation | 24° C. | 24° C. | 24° C. |
| When Thermal Head for Thermal Activation Reaches 78° C. | 55° C. | 42° C. | 42° C. |
| Embodiment according to the Present Invention | | | |
| Prior to Thermal Activation | 24° C. | 24° C. | 24° C. |
| When Thermal Head for Thermal Activation Reaches 78° C. | 45° C. | 32° C. | 34° C. |

Since a typical printable layer is colored at about 70° C.-80° C., even with the conventional structure, the temperature of the platen roller for thermal activation does not immediately rise to the temperature where the printable layer is colored. However, when the platen roller for thermal activation becomes as hot as about 60° C. and still the thermal activation process continues, if the thermal head for thermal activation in operation directly touches the platen roller for thermal activation during a brief period before the heat-sensitive adhesive sheet is introduced therebetween at the beginning of thermal activation, a portion of the platen roller for thermal activation which touches the thermal head for thermal activation becomes as hot as or hotter than 80° C. due to direct heat conduction from the thermal head for thermal activation, which may color the printable layer of the heat-sensitive adhesive sheet.

As shown in Table 1, even when the airflow of the opposite direction to that of the present invention is generated, the temperature drop is as small as about 5° C. Since the platen roller for thermal activation becomes as hot as about 55° C., as described above, when it directly touches the thermal head for thermal activation, a part of it becomes as hot as or hotter than 80° C., which may color the printable layer. Further, in addition to temperature rise of the platen roller for thermal activation and heating by the atmosphere, heat is also transferred from the inside of the heat-sensitive adhesive sheet during thermal activation to the printable layer, as a result of these kinds of heat acting together, the printable layer may be colored. It is to be noted that when the thermal insulation layer 10*c* is provided for the heat-sensitive adhesive sheet 10 as illustrated in FIG. 4, although the amount of heat reaching the printable layer 10*d* through the heat-sensitive adhesive sheet 10 is decreased, it is difficult to completely block the heat transfer.

On the other hand, when an airflow from the side of the platen for thermal activation to the side of the thermal head for thermal activation is generated as in the present invention, the platen roller for thermal activation is cooled to about 45° C. Therefore, since the temperature is lower than that of the conventional structure by about 15° C., it is unlikely that heat transferred by direct contact with the thermal head for thermal activation for a short time and heat transferred through the heat-sensitive adhesive sheet during the thermal activation rise the temperature to or above 80° C., and thus, the possibility that the printable layer is colored can be greatly decreased.

Next, an embodiment of the present invention is described where many adhesive labels were manufactured by using the printer structured as illustrated in FIG. 7.

In the present embodiment, adhesive labels manufactured from the heat-sensitive adhesive sheet 10 were 150 mm in length and 102 mm in width. The transport mechanism was controlled so that the adhesive labels were transported to the thermal activation apparatus 1 one by one intermittently every one second. As the fan 8 for exhausting air, a fan generating the maximum airflow of 0.5 $m^3/s$ and the maximum static pressure of 49 Pa was used. Many adhesive labels were manufactured with the room temperature being 25° C.

Figure 8:
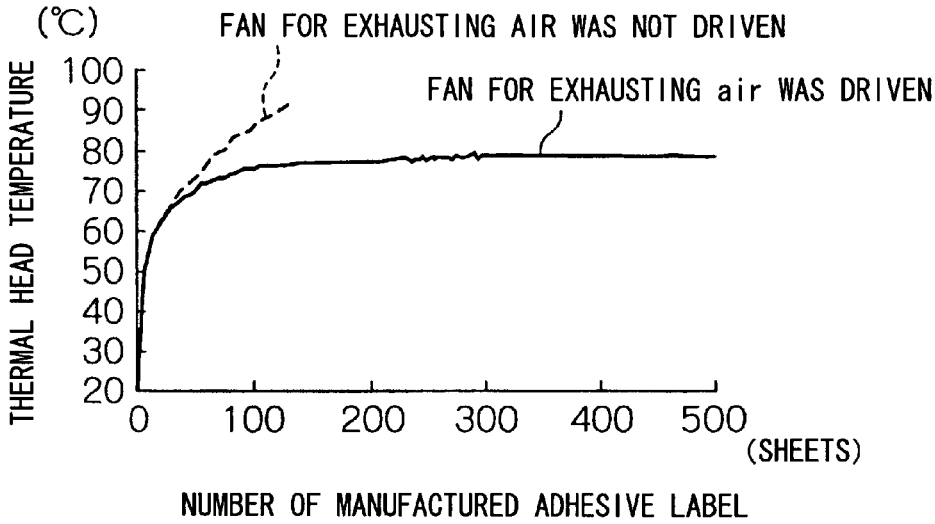
FIG. 8 is a graph showing a temperature change of a thermal head for thermal activation according to the embodiment of the present invention and of a comparative example during adhesive labels was manufactured.

A solid line in FIG. 8 shows a temperature change of the thermal head 2 for thermal activation when the fan 8 for exhausting air was driven all the time. For the purpose of comparison, a broken line in FIG. 8 shows a temperature change of the thermal head 2 for thermal activation when the fan 8 for exhausting air was not driven.

As shown in FIG. 8 by the broken line, when the fan 8 for exhausting air was not driven, in other words, when the airflow according to the present invention was not generated, the thermal head 2 for thermal activation became hotter than 90° C., which was the highest allowable temperature, when 129 adhesive labels were manufactured (after a lapse of about eight minutes from the beginning of the operation), and thus, the operation was stopped.

On the other hand, as shown in FIG. 8 by the solid line, when the fan 8 for exhausting air was driven, in other words, when the airflow A according to the present invention was generated, the temperature of the thermal head 2 for thermal activation stayed lower than 90° C., which was the highest allowable temperature, even when 500 adhesive labels were manufactured (after a lapse of about thirty minutes from the beginning of the operation), and the manufacture of the adhesive labels could be continued without abnormality. In particular, when about 120 adhesive labels were manufactured (after a lapse of about 7.5 minutes from the beginning of the operation), the temperature of the thermal head 2 for thermal activation almost stopped rising, and after 246 adhesive labels were manufactured (after a lapse of about fifteen minutes from the beginning of the operation) when the temperature of the thermal head 2 for thermal activation reached 78° C., the temperature was almost kept constant. That is, at this point, the temperature of the thermal head 2 for thermal activation is thought to be saturated, and theoretically, it is thought that, no matter how many adhesive labels are manufactured (no matter how long the operation continues) after that, the temperature does not reach the highest allowable temperature of the thermal head 2 for thermal activation and a normal operation continues. It is to be noted that, practically, there is a period where the operation is stopped to cool the thermal head 2 for thermal activation, for example, when the heat-sensitive adhesive sheet 10 runs out and a replacement of the roll is required. Therefore, if it can not be proved that, even when the adhesive labels are manufactured over several hours or over several dozens of hours, the temperature of the thermal head 2 for thermal activation does not reach the saturation temperature (78° C.), it can be said that the present invention has a practically sufficient cooling effect.

Figure 9:
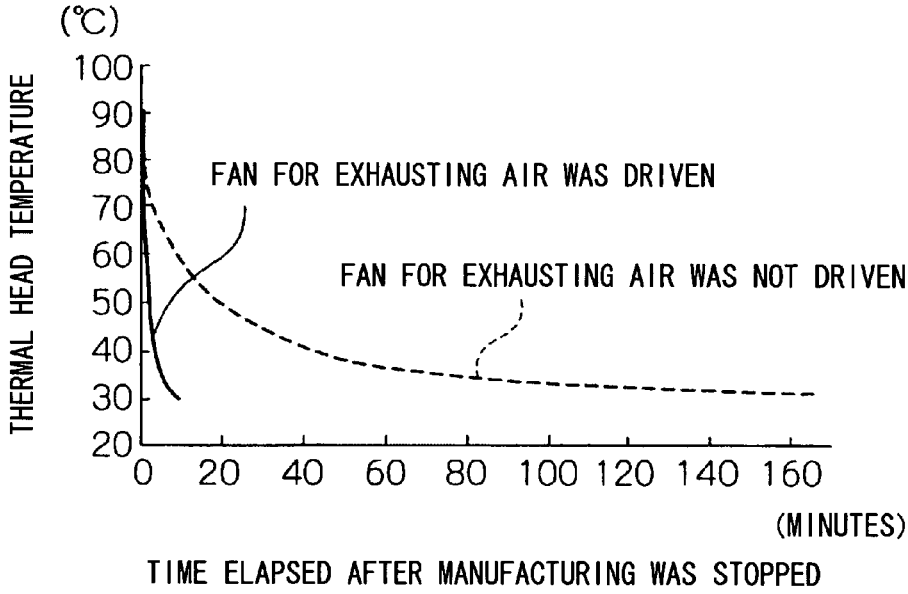
FIG. 9 is a graph showing a temperature change of the thermal head for thermal activation according to the embodiment of the present invention and of the comparative example after adhesive labels were manufactured.

FIG. 9 shows a temperature change of the thermal head 2 for thermal activation after the manufacturing process of these adhesive labels was stopped. As shown in FIG. 9 by a broken line, when the fan 8 for exhausting air was not driven and the airflow of the present invention was not generated, the temperature of the thermal head 2 for thermal activation, which rose to or higher than 90° C., dropped to 30° C. after about 166 minutes passed. On the other hand, when the fan 8 for exhausting air was driven to generate the airflow A of the present invention, as shown in FIG. 9 by a solid line, the temperature of the thermal head 2 for thermal activation, which rose to 78° C., dropped to 30° C. in only about nine minutes. In this way, the air cooling mechanism according to the present invention has a great effect also on the temperature drop of the thermal head 2 for thermal activation after the adhesive labels are manufactured.

Figure 10:
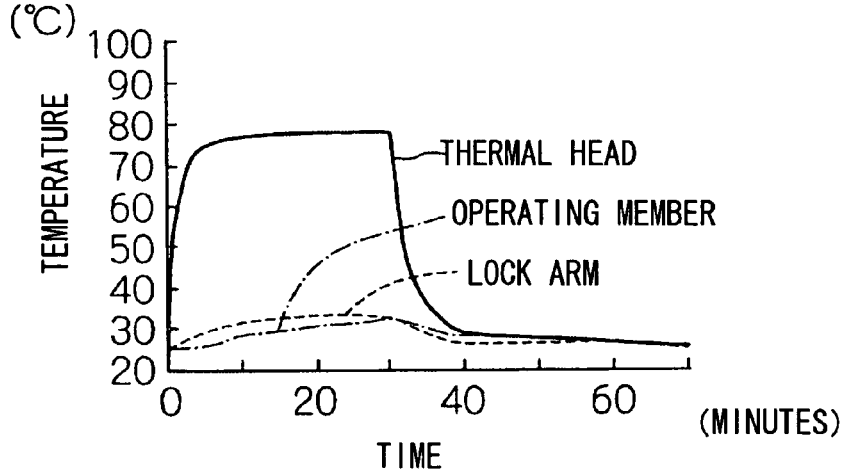
FIG. 10 is a graph showing a temperature change of the thermal head for thermal activation according to the embodiment of the present invention and of the surrounding members.

Next, a temperature change of the surroundings of the thermal head 2 for thermal activation of the present embodiment is described with reference to FIG. 10. A solid line in FIG. 10 is a combination of the solid line in FIG. 8 and that in FIG. 9, and shows that, as described in the above, 500 adhesive labels were manufactured in about thirty minutes, the temperature of the thermal head 2 for thermal activation dropped to 30° C. in about nine minutes, and after that, the temperature gradually dropped to around the room temperature (25° C.). The temperature change of the operation member 11 in this case is shown by alternate long and short dashed lines. According to this, as also shown in Table 1, since the temperature of the operation member 11 rises to only about 32° C. after 500 adhesive labels are manufactured in thirty minutes, even if a user touches the operation member 11, the user does not feel it hot. The temperature of the lock arm is shown by a broken line. Though not shown in the figures, the lock arm is located directly below the opening 20 (see FIG. 7) for discharging the adhesive labels outside the printer (adjacent to the second air inlet 7*b*). The lock arm is partly exposed to the outside, and may be touched by a user. Referring to the broken line and Table 1, since the temperature of the lock arm rose to only about 34° C. after 500 adhesive labels were manufactured in thirty minutes, even if a user touches the lock arm, similarly to the case of the operation member 11, the user does not feel it hot. Further, in the present embodiment, similarly to the cases of the lock arm and the operation member 11, the temperature rise of the platen roller 4 for thermal activation was limited to 45° C. (see Table 1), and drawbacks such as coloring of the printable layer 10*d* were not observed.

Figure 11:
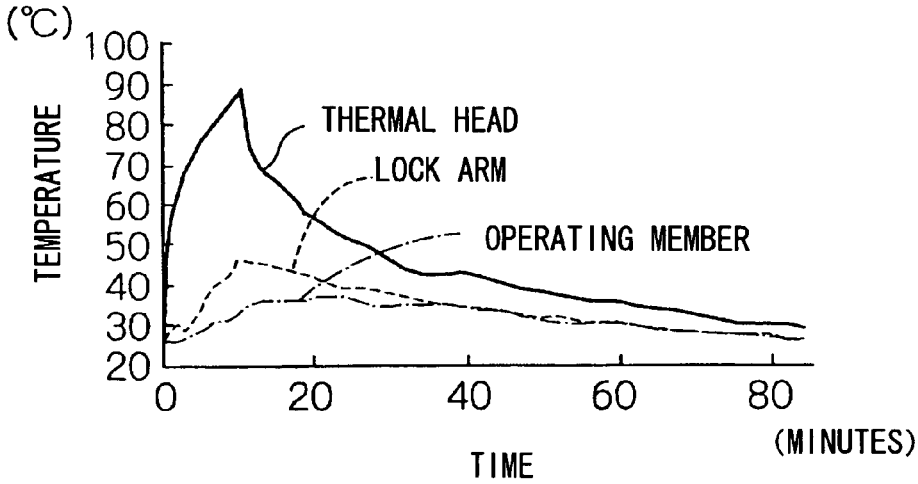
FIG. 11 is a graph showing a temperature change of a thermal head for thermal activation of a first comparative example and of the surrounding members.

For the purpose of comparison, temperature changes of the respective portions when the fan 8 for exhausting air was not driven and the airflow A of the present invention was not generated are shown in FIG. 11. As shown in FIGS. 8 and 9 by the broken lines, when 129 adhesive labels were manufactured in about eight minutes, the temperature of the thermal head 2 for thermal activation exceeded the highest allowable temperature and the operation was stopped. After that, although FIG. 11 shows the results only to the midway, it took about 166 minutes for the temperature of the thermal head 2 for thermal activation to drop to 30° C. The temperatures of the lock arm (not shown) and of the operation member 11 in this case are shown by a broken line and alternate long and short dashed lines, respectively. In this experiment, when the temperature of the lock arm reached about 48° C., the temperature of the thermal head 2 for thermal activation exceeded the highest allowable temperature and the operation was stopped. It is assumed from the graph that, if the manufacture of the adhesive labels continues, the temperature of the lock arm will still continue to rise. Therefore, when a user touches the lock arm and the adjacent housing, the user will feel them hot, and in some cases, may suffer a burn. Further, since the operation member 11 becomes as hot as about 43° C., when a user touches the operation member 11, the user feels it hot.

Figure 12:
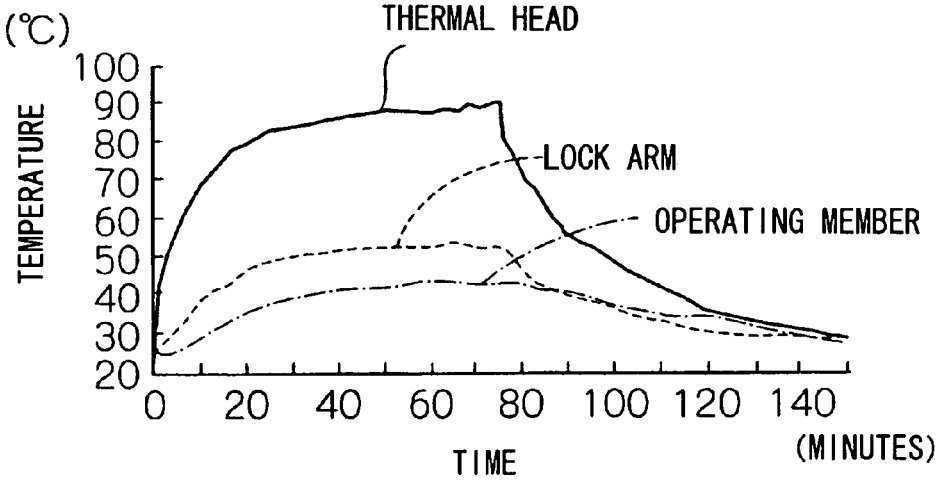
FIG. 12 is a graph showing a temperature change of a thermal head for thermal activation of a second comparative example and of the surrounding members.

Further, FIG. 12 shows a case where the fan 8 for exhausting air was not driven and the airflow A of the present invention was not generated, but, by prolonging the intervals to five seconds when the adhesive labels were transported to the thermal activation apparatus 1 one by one intermittently, the natural cooling effect was enhanced. In this comparative example, when 620 adhesive labels were manufactured in about eighty minutes, the temperature of the thermal head 2 for thermal activation exceeded the highest allowable temperature and the operation was stopped. The temperatures of the lock arm (not shown) and of the operation member 11 in this case are shown by a broken line and alternate long and short dashed lines, respectively. In this experiment, since the lock arm becomes as hot as about 55° C., when a user touches the lock arm or the adjacent housing, the user feels them considerably hot. Further, since the operation member 11 becomes as hot as about 43° C., when a user touches the operation member 11, the user feels it hot. In this comparative example, although the number of adhesive labels which could be continuously manufactured was increased, the temporal efficiency was considerably lowered, and, since the temperature rise of the operation member 11 and the like could not be controlled, hazards of a user could not be avoided.

What is claimed is:

1. A thermal activation apparatus, comprising:

a thermal head for thermal activation that heats and thermally activates a heat-sensitive adhesive agent layer of a heat-sensitive adhesive sheet, the heat-sensitive adhesive sheet comprising a printable layer on one side of a sheet-like substrate and the heat-sensitive adhesive agent layer on the other side of the sheet-like substrate, respectively;

a platen for thermal activation disposed so as to be opposed to the thermal head and that passes the heat-sensitive adhesive sheet between the platen and the thermal head; and an air cooling mechanism that generates an airflow from the side of the platen to the side of the thermal head to air cool the platen and the thermal head.

2. A thermal activation apparatus according to claim 1, wherein the air cooling mechanism comprises:

a first air inlet as an inlet of the airflow located on the side of the thermal head with respect to the heat-sensitive adhesive sheet as it passes between the thermal head and the platen;

a second air inlet as an inlet of the airflow located on the side of the platen; and an air outlet as an outlet of the airflow.

3. A thermal activation apparatus according to claim 1, wherein the air cooling mechanism includes partitions for substantially separating the airflow from the outside except for an outlet and an inlet of the airflow.

4. A thermal activation apparatus according to claim 1, wherein the air cooling mechanism comprises a fan for exhausting air provided at or adjacent to an outlet of the airflow or a fan for intaking air provided at or adjacent to an inlet of the airflow.

5. A printer comprising:

a thermal activation apparatus according to claim 1;

a printing apparatus for printing by heating the printable layer of the heat-sensitive adhesive sheet; and a transport mechanism that transports the heat-sensitive adhesive sheet through the thermal activation apparatus and the printing apparatus.

6. A printer according to claim 5, wherein the printing apparatus comprises:

a thermal head for printing by heating the printable layer of the heat-sensitive adhesive sheet, and a platen for printing disposed so as to be opposed to the thermal head for printing and that passes the heat-sensitive adhesive sheet between the platen for printing and the thermal head for printing, wherein the platen for thermal activation and the platen for printing constitute a part of the transport mechanism.

7. A thermal activation method comprising the steps of:

thermally activating a heat-sensitive adhesive agent layer of a heat-sensitive adhesive sheet which comprises a printable layer on one side of a sheet-like substrate and the heat-sensitive adhesive agent layer on the other side of the sheet-like substrate, by bringing the heat-sentive adhesive agent layer in contact with a thermal head for thermal activation and driving the thermal head to heat the heat-sensitive adhesive agent layer;

transporting, in synchronization with the thermally activating step, the heat-sensitive adhesive sheet between the thermal head and a platen for thermal activation by the platen which is disposed so as to be opposed to the thermal head; and air cooling the platen and the thermal head to suppress overheating by generating an airflow from the side of the platen to the side of the thermal head.

8. A thermal activation method according to claim 7, wherein the air cooling step is conducted simultaneously with the thermally activating step and the transporting step.

9. A thermal activation method according to claim 7, wherein the air cooling step is conducted with partitions substantially separating the airflow from the outside except for an outlet and an inlet of the airflow.

10. A method of manufacturing an adhesive label comprising the steps of:

printing on a printable layer of a heat-sensitive adhesive sheet which comprises the printable layer on one side of a sheet-like substrate and a heat-sensitive adhesive agent layer on the other side of the sheet-like substrate, by bringing the printable layer in contact with a thermal head for printing and driving the thermal head for printing to heat the printable layer;

thermally activating the heat-sensitive adhesive agent layer of the heat-sensitive adhesive sheet by bringing the heat-sensitive adhesive agent layer in contact with a thermal head for thermal activation and driving the thermal head for thermal activation to heat the heat-sensitive adhesive agent layer;

transporting, in synchronization with the printing step and the thermally activating step, the heat-sensitive adhesive sheet between the thermal head for printing and one platen and between the thermal head for thermal activation and another platen by the two platens disposed so as to be opposed to the thermal head for printing and the thermal head for thermal activation, respectively;

cutting the heat-sensitive adhesive sheet at a predetermined length; and air cooling the platen opposed to the thermal head for thermal activation and the thermal head for thermal activation to suppress overheating by generating an airflow from the side of the platen to the side of the thermal head for thermal activation.

11. A method of manufacturing an adhesive label according to claim 10, wherein the air cooling step is conducted simultaneously with the thermally activating step and the transporting step.

12. A method of manufacturing an adhesive label according to claim 10, wherein the air cooling step is conducted with partitions substantially separating the airflow from the outside except for an outlet and an inlet of the airflow.

* * * * *